US008176967B2

(12) United States Patent
Henkel et al.

(10) Patent No.: US 8,176,967 B2
(45) Date of Patent: May 15, 2012

(54) METHOD FOR PRODUCING A CAST COMPONENT WITH A CAST-IN PIPE

(75) Inventors: Horst Henkel, Dautphetal-Friedensdorf (DE); Michael Klaes, Kirchhain (DE)

(73) Assignee: Fritz Winter Eisengiesserei GmbH & Co. KG, Stadtallendorf (DE)

( * ) Notice: Subject to any disclaimer, the term of this patent is extended or adjusted under 35 U.S.C. 154(b) by 615 days.

(21) Appl. No.: 12/309,381

(22) PCT Filed: Jul. 13, 2007

(86) PCT No.: PCT/DE2007/001265

§ 371 (c)(1),
(2), (4) Date: Jan. 15, 2009

(87) PCT Pub. No.: WO2008/011863

PCT Pub. Date: Jan. 31, 2008

(65) Prior Publication Data

US 2009/0233116 A1 Sep. 17, 2009

(30) Foreign Application Priority Data

Jul. 23, 2006 (DE) ..... 10 2006 034 341

(51) Int. Cl.
*B22D 19/00* (2006.01)

(52) U.S. Cl. ..... 164/98; 164/122; 164/332

(58) Field of Classification Search ..... 164/98, 164/112, 332, 137, 340, 342
See application file for complete search history.

(56) References Cited

U.S. PATENT DOCUMENTS

| | | | | |
|---|---|---|---|---|
| 5,740,851 | A * | 4/1998 | Haynes | 164/98 |
| 6,158,400 | A | 12/2000 | Collie et al. | |
| 2003/0116137 | A1 | 6/2003 | Koseki et al. | |

FOREIGN PATENT DOCUMENTS

| | | |
|---|---|---|
| DE | 30 13 745 | 10/1981 |
| DE | 33 00 924 | 7/1984 |
| DE | 42 26 207 | 9/1993 |
| DE | 199 61 092 | 7/2000 |
| DE | 102 60 837 | 7/2003 |
| DE | 103 04 971 | 6/2004 |
| GB | 2 073 633 | 10/1981 |

OTHER PUBLICATIONS

English translation of International Preliminary Report on Patentability and Written Opinion of the International Searching Authority, of PCT/DE2007/001265 dated Feb. 17, 2009.
International Search Report, of PCT/DE2007/001265 mailed Dec. 5, 2007.

* cited by examiner

*Primary Examiner* — Kevin P Kerns
(74) *Attorney, Agent, or Firm* — Collard & Roe, P.C.

(57) ABSTRACT

A method produces a cast component of an internal combustion engine with a cast-in pipe. Expendable molds and a permanent pattern, or permanent molds are used in the method. A solid core mold is mounted in a split outer mold. To solve the problem of the pipe changing its position during the casting of the component, a separate pipe holder is integrated into the outer mold or the core mold. The pipe is inserted into a retaining section of the pipe holder that is configured in such a manner that it locally surrounds the outer circumference of the pipe at least in part and with little play so that the pipe can expand in the axial direction during casting but is secured against displacements in radial directions caused by buoyancy forces of the liquid casting material. Subsequently the component is cast.

19 Claims, 3 Drawing Sheets

METHOD FOR PRODUCING A CAST COMPONENT WITH A CAST-IN PIPE

CROSS REFERENCE TO RELATED APPLICATIONS

Figure 1:
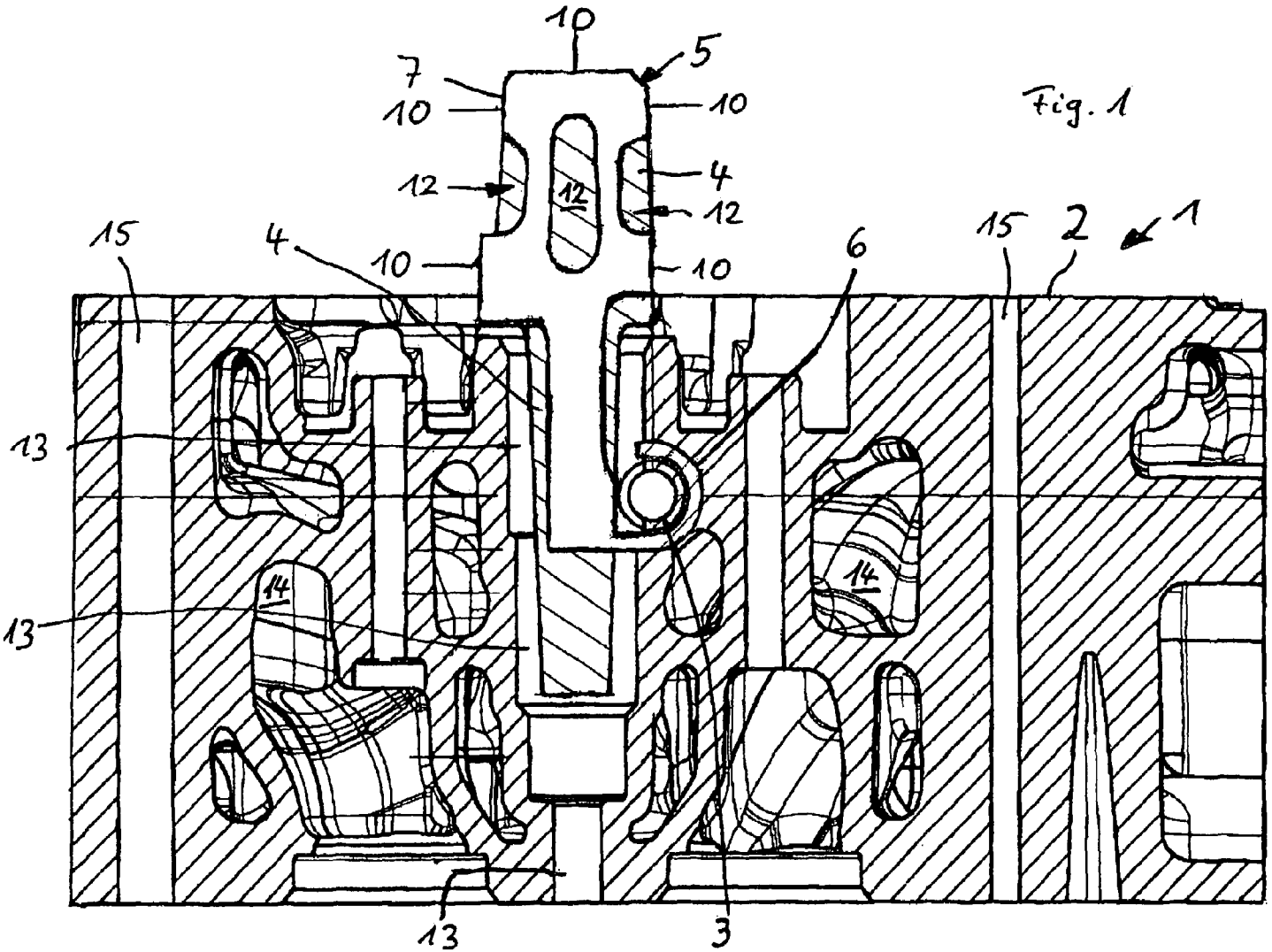

This application is the National Stage of PCT/DE2007/001265 filed on Jul. 13, 2007, which claims priority under 35 U.S.C. §119 of German Application No. 10 2006 034 341.7 filed on Jul. 23, 2006. The international application under PCT article 21(2) was not published in English.

The invention relates to a method for producing a cast component of an internal combustion engine with a cast-in pipe in a casting process with expendable moulds and a permanent pattern or in a casting process with permanent moulds in which a solid core mould is mounted in a split outer mould, as well as to a cast component of an internal combustion engine with a cast-in pipe and to a corresponding casting mould.

Internal combustion engines in the form of combustion engines are an essential component of vehicles (e.g. automobiles and commercial vehicles, ships etc.) and are also used as stationary engines. In this case, internal combustion engines have numerous cast components having at least one supply line (also called guide channel) which supplies a fluid medium (e.g. oil, water, gas and/or other liquid or gaseous media) to a required location in the engine and/or in adjacent regions. Some guide channels themselves can also used for cooling a component. Required locations are locations at which the respective medium is required, e.g. bearings to be lubricated, areas to be cooled, fuel pumps, fuel injection nozzles etc.

A supply line or plurality of supply lines occurs or occur in particular in a cylinder head, cylinder crankcase and/or attachment parts adjacent thereto. These are cast highly contoured components having core-formed inner contours. Inner contours in a cylinder head are for example: lower and upper water jacket, inlet passage (possibly with manifold), outlet passage, tappet and gear core, oil return, jet carrier etc.

As a result of the plurality of components to be accommodated in such cast components (in a cylinder head, for example, gaps or recesses for spark plugs, injection nozzles, valves, fastening means—e.g. cylinder head bolts—, supply lines, cooling channels, cooling water chambers, camshaft bearing points etc.), the spatial conditions are very constricted, which is why relatively complex casting moulds are required for casting. The course of the supply lines is determined by the respective constructive conditions and cannot be freely selected.

Supply lines (e.g. fuel lines and lubricant oil lines—in each case feed lines and return lines (leakage oil lines) are incorporated, i.e. drilled, in a known manner by mechanical processing on machine tools and/or transfer lines. For this purpose, long (partly parallel) holes and a plurality of shorter holes which form branches to the individual required locations, are drilled in the component in a plurality of complex working steps to be executed with high precision, which constitutes a considerable expenditure of work and therefore costs and investment expenditure. Subsequently, numerous, unrequired accesses must be permanently and reliably closed. Very long, rectilinear supply lines such as those of the main oil channel in a cylinder crankcase are now also cast in isolated cases by casting around a pipe or by leaving free by means of a corresponding core.

A disadvantage of supply lines which are mechanically incorporated subsequently into a component or which are left free by casting around cores is that the cast component exhibits casting porosities. When such supply lines are drilled, in order for example to connect a fuel injection nozzle, it is difficult to produce liquid-tight transitions in the transition regions.

It is known from DE 199 61 092 A1 to cast pre-formed small-diameter cooling channels as pipes in a cast cylinder block and/or cylinder head of a combustion engine during manufacture. These lead around components such as spark plugs or fuel injection nozzles and form a cooling system for the liquid cooling of the combustion engine. DE 33 00 924 C2 teaches, for water cooling of webs between cylinders of a cylinder block of a water-cooled internal combustion engine, which are cast closely and directly together, embedding tubes in the cast material which forms the webs, these tubes producing a connection between the lateral coolant water mantels of the cylinder block. Intensive cooling of the highly stressed web regions thus results.

DE 103 04 971 B4 discloses lubricant channels cast in as pipes into a cast crankcase for supplying bearing points (cam shaft bearings and/or crankshaft bearings) with lubricant. Due to the subsequent introduction of a main oil hole into the crankcase, the cast-in pipes are opened and the supply lines to the bearing points are therefore connected to the main oil bore.

DE 102 60 837 A1 describes a fuel line cast into a cylinder head as a pipe. In the course of the mechanical processing of the cylinder head, the pipe is drilled through and a fuel injection valve is inserted into this hole by means of sealing elements.

Cast components with supply lines cast in as pipes which are opened by mechanical processing measures at precisely specified points have so far in practice not been manufactured or not satisfactorily been manufactured. The difficulties involved in producing a cast component with a cast-in pipe are attributable to the fact that as a result of the severe heating during the casting process (in the case of cast iron, the heating of the pipe is around 800-900° C.), the pipe inserted into an outer mould and/or into a core mould is subjected to stressing due to the buoyancy forces of the liquid casting material as well as due to its own thermal expansion, which change it from its original mounted position. This has the consequence that the pipe is no longer in the predetermined position in the cast component. This then leads to problems particularly when the cast-in pipe is to be opened locally at exactly predetermined points in the course of mechanical after-treatment of the cast part.

The aforesaid core mould forms the inner contour of the casting and comprises one or more individual cores or an assembled core package, wherein the said components of the core mould are produced in a known manner in core tools by means of different and usual production processes, e.g. from a mineral, refractory, granular base material and a binder.

The object of the invention is to provide a method for producing a cast component of an internal combustion engine having one or more cast-in pipe(s), which can solve the problem of positional displacement of the pipe during casting. It is further the object of the invention to provide a cast component with at least one cast-in pipe and a corresponding casting mould.

This object is achieved according to the invention in a method as described herein.

By providing at least one separate pipe holder integrated into the singly or multiply split outer mould and/or into the core mould having the features according to the invention, it is possible to cast a pipe into a component with high positional accuracy. This means that despite the forces acting on the pipe during casting, the pipe retains precisely the predetermined position and/or the position can only vary within predetermined limits. A plurality of supply lines are advantageously cast in as pipes.

The pipe holder used in the method according to the invention is a separate element which is integrated into the outer mould or into the core mould (into an individual core or into a core package) before casting. The precise number of pipe holders required for the positionally accurate casting-in of the pipe depends on the type of component to be cast. In the case of a plurality of pipe holders, these can be integrated exclusively into the outer mould or exclusively into the core mould. It is also possible to integrate at least one pipe holder in the outer mould and at least one pipe holder in the core mould. The pipe holder is thereby firmly anchored in the outer mould or in the core mould. If a plurality of pipe holders are used, these are present as separate elements, i.e. these are individual elements which have no rigid connection to one another. They can be used in each case at the positions within the entire mould structure at which they are required to secure its predetermined position for the cast-in pipe. Since the individual pipe holders are not connected to one another, they are not subjected to the deformation forces caused by the casting technology such as cast-in pipes without holders or cast-in pipes together with a rigid positioning device (cf. DE 42 26 207 C1) suffer.

The pipe holder used in the method according to the invention comprises an anchoring section for anchoring in the outer mould or core mould and a retaining section for receiving and mounting the pipe to be cast-in. The pipe holder can also be designated as "centring element".

In the course of the core assembly (i.e. the assembly of the casting mould), the pipe is inserted into the retaining section of the pipe holder. Since the retaining section was configured in such a manner that it at least partially locally surrounds the outer circumference of the pipe, the pipe is secured against radial deviation from the central position caused by the buoyancy forces of the liquid casting material during the casting process. The pipe is mounted within a narrow tolerance. The retaining section can preferably have an eye-like or stirrup-like shape. Other configurations with contours adapted to the pipe are naturally also possible. Since a small distance (i.e. small play) exists between the inner contour of the retaining section and the outer circumference of the pipe, the pipe can expand and/or move in its axial direction during casting so that it undergoes no deformation. The pipe is thus mounted buoyantly during casting. The distance between the inner contour of the retaining section and the outer circumference of the pipe depends on the respective tolerance region. The height of the respective tolerance region is determined by the size of the component to be cast in each case. The distance can preferably be 0.2 mm circumferentially (relative to cast components for internal combustion engines from the automobile and commercial vehicle sector). The component is then cast with the respective method.

The component can be fabricated by different casting methods. According to a first advantageous variant of the method, the component is cast in a casting method using an expendable mould and permanent pattern, e.g. in a pure core moulding method, a core moulding in conjunction with green-sand moulding method, a core moulding in conjunction with cold resin moulding method etc. According to a second advantageous variant of the method, the component is cast in a casting method with a permanent mould, e.g. chill casting, die casting, injection moulding etc.

It is advantageous if the pipe holder consists of a material which is related to the casting material of the cast component, i.e., the physical properties (in particular the melting points) should match one another. If the respective materials are matched to one another, it is thereby advantageously achieved that the pipe holder begins to melt at the edge during casting of the component and a firm connection with the casting is thus formed. In the case of a component to be cast consisting of cast iron or a cast iron alloy, the holder should likewise advantageously consist of cast iron, a cast iron alloy or preferably of steel. In the case of a component made of light metal, a light metal holder should be used, in the case of a component made of non-ferrous metal or a non-ferrous metal alloy, a holder made of non-ferrous metal or a non-ferrous metal alloy should be used etc.

The material of the pipe to be cast in is also advantageously thus matched to the respective casting material so that the pipe begins to melt on the circumference during the casting. As a result, a particularly firm connection is produced and a high loading capacity of the casting is achieved.

According to an advantageous further development of the method according to the invention, a plate-shaped element is integrated as a pipe holder in the outer mould or in the core mould. "Plate-shaped" means in this case that this is a flat element which is delimited on two opposite sides by respectively one essentially flat face which is extended in relation to the thickness. Such a pipe holder can be produced inexpensively in large numbers from a metal sheet, e.g. cut out. Further advantages of a plate-shaped pipe holder are that it can be readily received by the core tool and can be readily integrated during fabrication of the core or fabrication of the mould. Naturally, the individual pipe holder could also be differently configured e.g. a single body fabricated by welding construction or casting construction which is integrated in each case at a single position point (i.e. a point at which the pipe should be held accurately in position) in the outer mould or in the core mould.

It is advantageous if the anchoring section of the pipe holder is incorporated into the outer mould or core mould (e.g. is injected therein) directly during fabrication of the outer mould or the core mould, since a strong play-free anchoring is thus achieved. Subsequent incorporation of the pipe holder into the outer mould or core mould is likewise possible but more expensive. During fabrication of the outer mould or core mould, the pipe holder is advantageously positioned three-dimensionally positionally accurately in the outer mould or core mould. For that purpose, the pipe holder has at least one abutting piece (e.g. a circumferential abutting piece), preferably a plurality of abutting pieces, abutting positions, abutting surface or the like.

In order not to weaken the stability of the core mould or the outer mould by incorporating the pipe holder, advantageously at least one recess has been formed on the pipe holder. The strength of the core mould and/or core strength is thus maintained despite the inserted pipe holder.

In a preferred further development of the method according to the invention, non-cast-in parts of the pipe holder are removed after casting the component. For this purpose it is advantageous if a pipe holder is cast in which has at least one predetermined breaking point in at least one predetermined region or at least one defined point. This can comprise, for example, a locally imprinted indentation. By means of this simple measure, after casting the component in the course of cleaning processing, regions of the pipe holder which have not been cast in can be inexpensively removed from the component, these particularly comprising the anchoring sections located in the mould during casting.

Depending on the construction of the components to be cast and the mould structure corresponding to this, i.e. the outer mould, and the required core structure, i.e. the inner mould, the pipe holders are differently designed and adapted to the respective requirements. If, for example, according to an advantageous variant several pipes are to be cast in and mounted positionally accurately during casting, a pipe holder having a plurality of corresponding retaining sections can advantageously be used.

According to an advantageous further development of the method according to the invention, in the course of the mechanical processing of the cast component the cast-in pipe is opened at a predetermined point, i.e. cut through or, which can be advantageously achieved, cut at the edge. The method of production according to the invention is particularly well suited for such embodiments. The use according to the invention of a pipe holder according to the invention or of a plurality of pipe holders according to the invention makes it possible for the first time to achieve exact, positionally accurate casting of pipes into a cast component by means of an inexpensive measure. Despite the forces acting on the pipe during casting, the cast-in pipe in the cast component is located exactly in the position in which it is required for the subsequent mechanical processing. As a result of the positioning accuracy of the cast-in pipe achieved according to the invention, it is advantageously possible for the first time to specifically cut the cast-in pipe only at the edge in the course of mechanical treatment. Depending on the cast component, the mechanical processing can comprise, for example, the incorporation of a main oil hole, the incorporation of a hole for injection nozzles and/or injection pumps etc. The very high positional accuracy required in the cutting region of the mechanical processing to the cast-in pipe is achieved by the method according to the invention. The pipe holder is preferably positioned at the center of the planned mechanical treatment in relation to the mold structure since the cast-in pipe can be found there with the highest accuracy.

Advantageously, a cylinder head, a crankcase or an attachment part of the crankcase, in particular a gear case, a chain case, an oil pan or the like can be cast in by the method, wherein at least one pipe is cast in as a fuel line, lubricant line or as a supply line for another fluid medium. The said components in which the inner contours are formed by core moulds can have a plurality of different supply lines. Positionally accurate cast-in pipes which are in some cases mechanically opened at predetermined points (cut through and/or initially cut) thus offer many advantages here. In an advantageous further development, pipe holders each having one or more retaining section(s) are integrated as required in core moulds and/or in individual cores which each leave a recess free (for example, in pump cores, nozzle cores, channel cores, water jacket cores, crank space cores, bore cores etc.). One pipe or a plurality of pipes is/are inserted in the retaining sections and after casting the component, non-cast-in regions of the pipe holders are removed. In the course of mechanical processing of the component, the pipes are opened, if necessary in the regions of the recesses left open or at other points, in particular by mechanical cutting.

The aforesaid object is further achieved by a cast component of an internal combustion engine having the features described herein.

The cast component of an internal combustion engine configured according to the invention is characterised in that it has a cast-in retaining section of a pipe holder or a part thereof, which is arranged locally on the outer circumference of the cast-in pipe. In this case, the pipe holder integrated into the outer mould or into the core mould served the purpose of mounting the pipe during casting of the component in such a manner that the pipe could expand in the axial direction but was secured in radial directions against displacements caused by the buoyancy forces of the liquid casting material. The cast component according to the invention thus has a positionally accurately cast-in pipe which, for example, is a requirement if the pipe is to be specifically opened at a precisely predetermined point in the course of a mechanical treatment or is not to be affected by an incorporated hole at a predetermined point.

According to an advantageous embodiment, the cast-in pipe is a fuel line. A lubricant line as a cast-in pipe or a line for another fluid medium can advantageously also be achieved. The cast component can advantageously be a cylinder head. As a result of the restricted spatial conditions in such a component as described initially, the solution according to the invention is suitable here. Alternatively, the cast component can advantageously be a crankcase or an attachment part of the crankcase, in particular a gear case, a chain case, an oil pan or the like.

In addition, the object specified initially is achieved with a casting mold having the features described herein.

Advantageous embodiments of the casting mold are also described herein. The individual features and advantageous of the pipe holder used within the scope of the invention have already been described in connection with the method according to the invention. In order to avoid repetition, reference is made in this respect to the corresponding explanations above.

Figure 2:
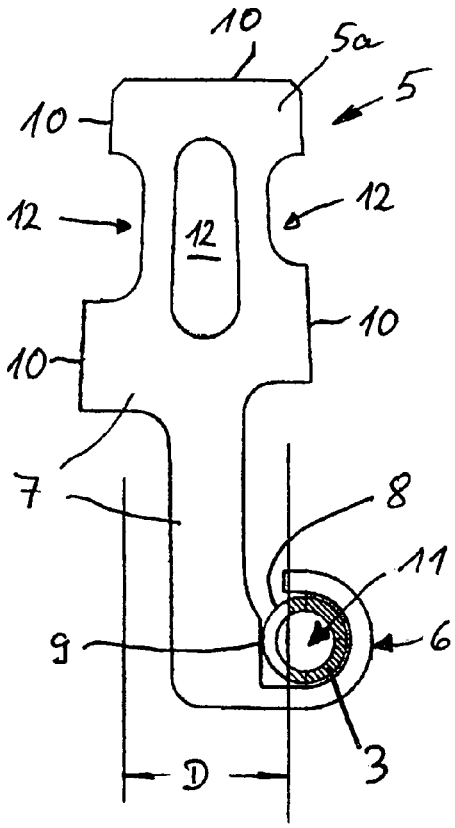
Figure 3:
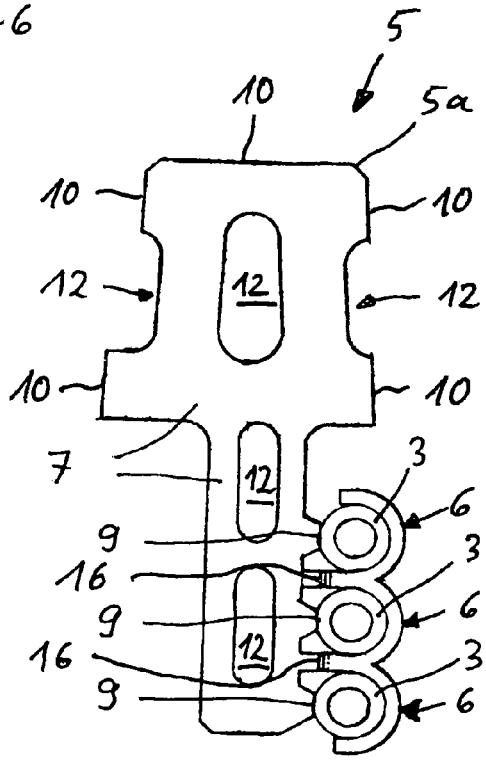
Figure 3A:
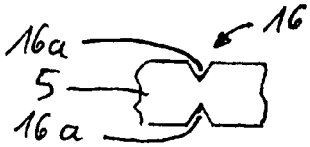
Figure 4:
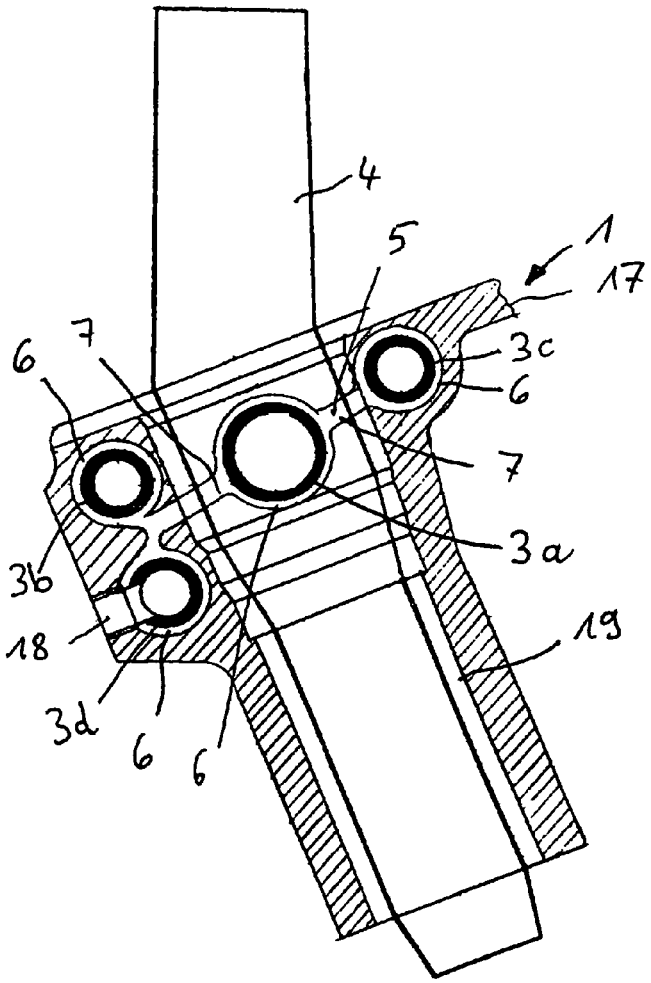
Figure 5:
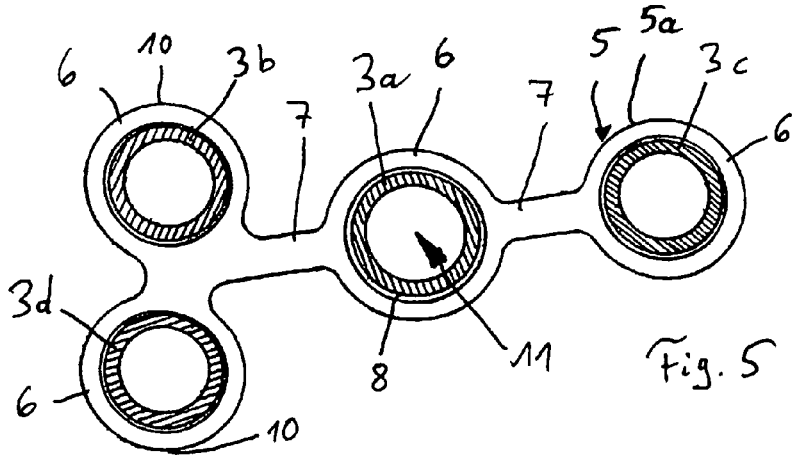

In the drawings, cast components and pipe holders are shown schematically to illustrate the invention. In the figures:

FIG. 1 shows a cross-section through a cylinder head cast according to the invention with a first embodiment of a pipe holder according to the invention, FIG. 2 shows the pipe holder from FIG. 1, FIG. 3 shows a second embodiment of a pipe holder according to the invention, FIG. 3*a* shows a detail from FIG. 3, FIG. 4 shows a sectionwise cross-section through a crankcase cast according to the invention with a third embodiment of a pipe holder according to the invention and FIG. 5 shows the pipe holder from FIG. 4.

FIG. 1 is a schematic diagram showing different stages in the production according to the invention of a cast component 1 of an internal combustion engine according to the invention with a cast-in pipe 3 as a supply line. The component shown which has already been mechanically treated is, as an example, a cylinder head 2 which was produced in a casting process using expendable moulds and a permanent pattern or a casting process using permanent moulds in which a solid core mould 4 is mounted in each case in a split outer mould. In this example the supply line is a fuel line.

The pipe 3 was cast exactly in position in the cylinder head 2 by means of a pipe holder 5 according to the invention which is shown separately in FIG. 2. For this purpose, before casting the pipe holder 5 was integrated in a core mold 4 (in this case, in an individual core which leaves open a recess for an injection nozzle). In the cylinder head 2 shown as an exemplary embodiment, respectively one pipe holder 5 was integrated in a plurality of core molds 4 each leaving open an injection nozzle recess. The pipe 3 to be cast in was inserted in the course of assembling the core into retaining sections 6 of the pipe holders 5, whose configuration and function is described further below. After assembling the core molds 4 to form a complete inner mold forming the inner contour of the component 1, and mounting the inner mold into the respective singly or multiply split outer mold which forms the outer contour of the component, the cylinder head 2 was cast by the respective method. Depending on the respective design of the cylinder head to be cast, the core or the cores for the injection nozzle recess(es) could be mounted alternatively in a hood core or in an outer mold half.

In this exemplary embodiment, the pipe holder 5 shown in FIGS. 1 and 2 is configured as a plate-shaped element 5*a* and was produced, for example, from a steel sheet. This has an anchoring section 7 which is anchored free from play in the core mould 4 which can be seen in FIG. 1 and has a retaining section 6 for receiving the pipe 3 to be cast in. The retaining section 6 is configured in such a manner that it locally surrounds the outer circumference 8 of the pipe 3, at least in part, and with little play (in this case, preferably 0.2 mm circumferentially), as can be seen from FIG. 2. This has the result that the pipe 3 can expand in the axial direction during casting but is secured in radial directions against displacements caused by the buoyancy forces of the liquid casting material. In this case, the retaining section 6 is advantageously configured as stirrup-shaped and comprises a pipe abutment position 9 for securing the pipe towards the inside.

In the embodiment shown in FIGS. 1 and 2, the pipe holder 5 and specifically the anchoring section 7 was incorporated into the core mould 4 directly during its manufacture (e.g. injected into the core). In order to hold the pipe holder 5 in the core tool three-dimensionally in the required position during production of the core mould 4 and thereby introduce it positionally accurately into the core mould 4, the anchoring section 7 has an abutting piece 10, advantageously at least two abutting pieces 10 (abutting positions, abutting surfaces etc.). In order to keep the number of abutting pieces 10 and therefore the expenditure for exact positioning low, the retaining section 6 of the pipe holder 5 advantageously forms a centring position 11, for example, by engaging a mandrel in the retaining section 6 in the core tool. Due to the abutting pieces 10 and the centring position 11, the pipe holder 5 is introduced positionally accurately into the core mould 4, achieving that the pipe can be cast into the component positionally accurately. In this way, the three-dimensional parameters for the pipe in the subsequent casting are precisely predefined beforehand.

In order not to weaken the core mold 4 by the inserted anchoring section 7, i.e. to prevent any collapse of the core mold 4, the pipe holder 5 has at least one recess 12. In the exemplary embodiment shown, three such recesses 12 are formed in the anchoring section 7.

After casting the component 1 and desanding the raw casting (i.e. removing core and/or mould material), regions of the pipe holder 5 which have not been cast in, in particular the anchoring sections 7 which had been integrated in the core mould 4 are removed as part of cleaning measures. Thus, only the regions of the pipe holder 5 which had been cast into the casting (in particular parts of the retaining sections 6) remain in the cast component 1. It can be seen from the cast-in retaining sections 6 and/or parts thereof which are disposed on the outer circumference 8 of the pipe 3 that the cast component 1 was produced by the method according to the invention.

It can be seen from FIG. 1 that the pipe 3 (fuel line) cast positionally accurately into the cylinder head 2 is opened at a predetermined position in the course of the mechanical treatment of the cast component 1. Specifically the pipe is initially cut at the edge when incorporating the stepped injection nozzle hole 13. Furthermore, other cavities 14 formed by cores and subsequently introduced holes 15 can be identified in the component 1, some being provided with reference numerals as an example.

The diameter of the injection nozzle hole 13 in the area of the cast-in pipe 3 is given as D in FIG. 2. Here it can again be seen in enlarged view how the pipe 3 is opened tangentially for supplying an injection nozzle inserted later in the injection nozzle hole 13.

The positionally accurate casting of a fuel line as a pipe in a cylinder head has been explained previously as an example. The pipe holder shown or modified accordingly can naturally also be used to cast in other supply lines (e.g. for lubricant, water or another fluid medium) into a cylinder head or into another cast component of an internal combustion engine (e.g. crankcase, chain case, gear case etc.).

FIG. 3 shows a second embodiment of a pipe holder 5 according to the invention. The same features as in FIG. 2 are designated with the same reference numerals. The pipe holder 5 has a plurality of retaining sections 6 (three retaining sections are shown here as an example, naturally other numbers are also possible) so that a plurality of pipes 3 can be mounted positionally accurately during casting of the component 1 with such a pipe holder 5 inserted into a core mould 3 or an outer mould. The pipe holder 6 has a plurality of abutting pieces 10. One retaining section 6 is a centring position 11 of the holder 5 during insertion into the core mould 4.

The pipe holder 5 in FIG. 3 has predetermined breaking points 16. By means of this measure it is possible to remove the non-cast-in part of the pipe holder 5 from the recess formed by the core mould 4 in an inexpensive manner after casting and desanding the component 1. The principle of a predetermined breaking point is shown in FIG. 3*a* and comprises, for example, an indentation 16*a* locally imprinted into the pipe holder 5 in a predetermined region. The pipe holder 5 can be broken off at these points by bending. Other types of a predetermined breaking point are naturally also possible.

FIGS. 4 and 5 show a second exemplary embodiment of a component 1 for an internal combustion engine according to the invention cast by the method according to the invention having a plurality of positionally accurately cast in pipes 3 as supply lines. Here it is a matter of a section from a cast crankcase 17.

The four pipes 3 which can be seen here were cast positionally accurately into the crankcase 17 by means of a pipe holder 5 according to the invention which is shown separately in FIG. 5. For this purpose, the pipe holder 5 was integrated into a core form 4 (in this case, into an individual core which leaves open a recess for a fuel pump) before casting. During production of the crankcase, respectively one pipe holder 5 was integrated into a plurality of core moulds 4 each leaving open a fuel pump recess. The pipes 3 to be cast in were inserted in the course of assembling the core, into the retaining sections 6 of the pipe holders 5 whose configuration and function is described further below. After inserting the core moulds 4 into the outer mould, the core moulds 4 in this case forming partial regions of the outer contour of the component 1, and mounting the inner mould into the respective singly or multiply split outer mould forming the outer contour of the component, the crankcase 17 was cast with the respective method.

The pipe holder 5 shown in FIGS. 4 and 5 is configured as a plate-like element 5*a* in this exemplary embodiment and was made, for example, from a steel sheet. This has web-like anchoring sections 7 here which are anchored free from play in the core mould 4 which can be seen in FIG. 4 and four retaining sections 6 for receiving the pipes 3 to be cast-in. The retaining sections 6 are configured in such a manner, as can be seen in FIG. 5, that they locally surround the outer circumference 8 of the respective pipe 3 in this case completely and with little play (in this case, preferably 0.2 mm circumferentially). This has the result that the pipes 3 can expand in the axial direction during casting but are secured in radial directions against displacements caused by the buoyancy forces of the liquid casting material. The retaining sections 6 are advantageously configured here as annular. Naturally, different numbers, configurations and arrangements of retaining section on the pipe holder are possible, e.g. region in which the retaining section does not completely surround a pipe.

The pipe holder 5 was inserted positionally accurately into the core mould 4 by means of the abutting pieces 10 and the centring position 11 shown as an example.

In the exemplary embodiment, the pipe 3*a* surrounded by the core mould 4 is a fuel line. In the course of the mechanical processing, the non-cast-in regions of the pipe holder 5 are removed after casting and desanding the cast component 1. In this case, the anchoring sections 7 and the retaining section 6 of the central pipe 3*a* are removed and the pipe 3*a* thereby cut through for example during the treatment of the fuel pump recess left open by the core mould 4 when incorporating the pump hole 19. The cast-in pipe 3*b* forms, for example, a fuel return line. The cast-in pipe 3*c* can be a lubricant line. The lower pipe 3*d* which was initially cut laterally here by a mechanically incorporated hole 18 can carry lubricant and form a connection point for the lubricant supply to an attachment component of the crankcase 17.

The positionally accurate casting of supply lines as pipes in a crankcase has been described as an example with reference to FIGS. 4 and 5. The pipe holder shown or suitably modified can naturally also be used for casting in other supply lines filled with a fluid medium into a crankcase or into another cast component of an internal combustion engine (e.g. chain case, gear case, cylinder head etc.). In which type of core mould or at which points in the outer mould the respective pipe holder is inserted depends on the component to be cast and the constructive conditions. The method according to the invention can also be applied to cast components, in particular those with core-formed inner contours, which are not within the scope of an internal combustion engine, e.g. to cast components used in installation engineering.

REFERENCE LIST

1 Cast component
2 Cylinder head
3 Pipe
3*a* Pipe
3*b* Pipe
3*c* Pipe
3*d* Pipe
4 Core mould
5 Pipe holder
5*a* Plate-like pipe holder
6 Retaining section of 5
7 Anchoring section of 5
8 External circumference of 5
9 Pipe abutting position
10 Abutting piece
11 Centring position
12 Recess
13 Injection nozzle hole
14 Cavity
15 Hole
16 Predetermined breaking point
16*a* Indentation
17 Crankcase
18 Hole
19 Pump hole
D Diameter

The invention claimed is:

1. A method for producing a cast component of an internal combustion engine with a pipe cast into the cast component in a casting process with:

expendable molds and a permanent pattern, or with permanent molds, the method comprising steps of:

integrating a separate pipe holder in a split outer mold or a solid core mold;

inserting the pipe in a retaining section of the separate pipe holder in such a manner that the retaining section surrounds at least part of an outer circumference of the pipe with little play;

mounting the solid core mold in the split outer mold; and introducing casting material in liquid form to form the cast component cast in such a manner that during the casting, due to the little play of the pipe in the retaining section of the separate pipe holder, the pipe can expand in an axial direction but is secured against radial displacement caused by buoyancy forces of the casting material.

2. The method according to claim 1, wherein the separate pipe holder comprises a material of a similar composition as the casting material of the cast component.

3. The method according to claim 1, wherein the separate pipe holder is a plate-like element.

4. The method according to claim 1, wherein the separate pipe holder is integrated into the split outer mold or the solid core mold in that an anchoring section of the separate pipe holder is incorporated into the split outer mold or the solid core mold directly during manufacture of the split outer mold or the solid core mold.

5. The method according to claim 1, wherein the separate pipe holder is positioned positionally accurately in the split outer mold or in the solid core mold with the aid of at least one abutting piece provided on the separate pipe holder.

6. The method according to claim 1, wherein the separate pipe holder has a recess.

7. The method according to claim 1, further comprising a step of:

removing non-cast-in regions of the separate pipe holder after the casting is finished.

8. The method according to claim 7, wherein a predetermined breaking point is provided on the separate pipe holder in a predetermined region of the separate pipe holder.

9. The method according to claim 1, wherein a plurality of pipes to be cast in are mounted positionally accurately during the casting via the separate pipe holder, the separate pipe holder having a plurality of retaining sections for the plurality of pipes.

10. The method according to claim 1, further comprising a step of:

mechanically processing the cast component;

wherein the pipe is opened at a predetermined point during the processing.

11. The method according to claim 1, wherein the cast component is at least one member selected from the group consisting of: a cylinder head, a crankcase, an attachment part of a crankcase, a gear case, a chain case, and an oil pan; and wherein the pipe is cast in as a fuel line, lubricant line, or a supply line for another fluid medium.

12. The method according to claim 11, wherein pipe holders with respectively one or more retaining section(s) are integrated in core molds and/or in individual cores which each leave open a recess in the component;

wherein a pipe or a plurality of pipes is/are inserted in the retaining sections;

wherein after casting the component, non-cast-in regions of the pipe holders are removed; and wherein in a course of mechanical treatment of the component the pipe or the pipes, if necessary, is/are mechanically opened in regions of the left-open recesses or in other regions.

13. A casting mould mold comprising:

a split outer mold able to form an outer contour of a component to be cast;

a core mold inserted in the split outer mold for shaping an inner contour of a component to be cast; and a pipe holder having an anchoring section, the anchoring section being integrated in:

the split outer mold, or in the core mold;

wherein the pipe holder has a retaining section for receiving and positionally accurate mounting of a pipe to be cast in during casting; and wherein the retaining section is configured in such a manner that the retaining section surrounds at least part of an outer circumference of an inserted pipe with little play.

14. The casting mold according to claim 13, wherein the pipe holder comprises a material of a similar composition as a casting material of the cast component.

15. The casting mold according to claim 13, wherein the pipe holder is a plate-like element.

16. The casting mold according to claim 13, wherein the pipe holder has at least one abutting piece for accurate positioning of the pipe holder in the core mold or in the split outer mold.

17. The casting mold according to claim 13, wherein the pipe holder has at least one recess on the anchoring section.

18. The casting mold according to claim 13, wherein the pipe holder has a predetermined breaking point in a predetermined region of the pipe holder.

19. The casting mold according to claim 13, wherein the pipe holder has a plurality of retaining sections.

* * * * *

UNITED STATES PATENT AND TRADEMARK OFFICE

CERTIFICATE OF CORRECTION

PATENT NO. : 8,176,967 B2
APPLICATION NO. : 12/309381
DATED : May 15, 2012
INVENTOR(S) : Henkel et al.

It is certified that error appears in the above-identified patent and that said Letters Patent is hereby corrected as shown below:

In the Claims:

In Column 10, line 22 (Claim 1) after "component" please delete: "cast".

Signed and Sealed this
Third Day of September, 2013

Teresa Stanek Rea
*Acting Director of the United States Patent and Trademark Office*